US006916172B2

(12) United States Patent
Steiner

(10) Patent No.: US 6,916,172 B2
(45) Date of Patent: Jul. 12, 2005

(54) BURNER APPARATUS

(75) Inventor: Michael C. Steiner, Tomball, TX (US)

(73) Assignee: L & S Cryogenics, Inc., Spring, TX (US)

( * ) Notice: Subject to any disclaimer, the term of this patent is extended or adjusted under 35 U.S.C. 154(b) by 0 days.

(21) Appl. No.: 10/647,815

(22) Filed: Aug. 25, 2003

(65) Prior Publication Data

US 2005/0048430 A1 Mar. 3, 2005

(51) Int. Cl.[7] ..... F23Q 9/00

(52) U.S. Cl. ..... 431/278; 431/284; 431/285; 431/181; 431/185; 431/187; 431/352

(58) Field of Search ..... 431/278, 284, 431/285, 181–185, 187, 350, 352, 353, 242–243; 60/755–760; 110/260–265

(56) References Cited

U.S. PATENT DOCUMENTS 4,492,171 A * 1/1985 Brashears et al. ..... 431/184
4,915,038 A * 4/1990 Sujata et al. ..... 110/346
5,123,401 A * 6/1992 Lange ..... 431/242
5,275,554 A * 1/1994 Faulkner ..... 431/115
5,520,536 A 5/1996 Rodgers et al.

* cited by examiner

*Primary Examiner*—Jiping Lu
(74) *Attorney, Agent, or Firm*—C. James Bushman; Browning Bushman P.C.

(57) ABSTRACT

A burner apparatus comprising housing defining a chamber and having an air inlet, a peripherally extending baffle disposed in the housing, a first peripherally extending flow passage being formed between the housing and the baffle, the first flow passage being in open communication with the air inlet, a peripherally extending combustion liner disposed inwardly of the baffle, a second peripherally extending flow passage being formed between the liner and the baffle, the second flow passage being in open communication with the first passage, a reversing diverter disposed in the chamber and positioned to direct air flowing from the first flow passage into the second flow passage, a burner assembly mounting plate disposed in the liner and having a first side and a second side, the mounting plate and the liner at least partially defining a burner barrel on the first side of the mounting plate, at least one burner assembly mounted on the burner mounting plate and a plenum on the second side of the mounting plate that is in open communication with the second flow passage.

42 Claims, 5 Drawing Sheets

FIG. 3
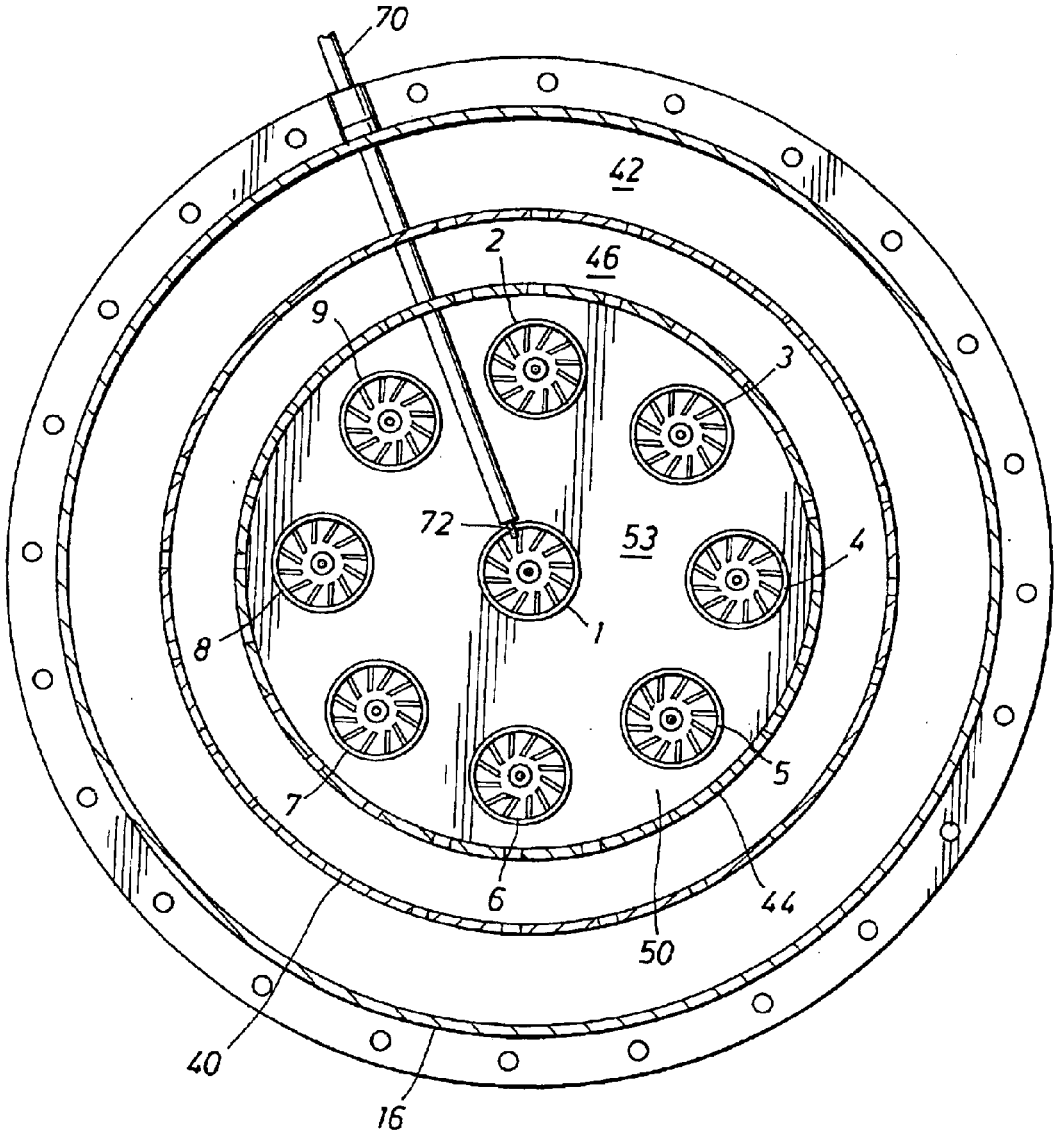
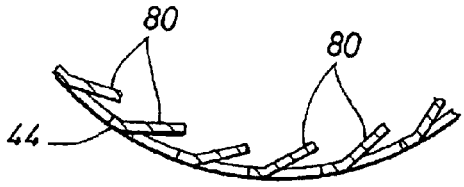
FIG. 4

FIG.7
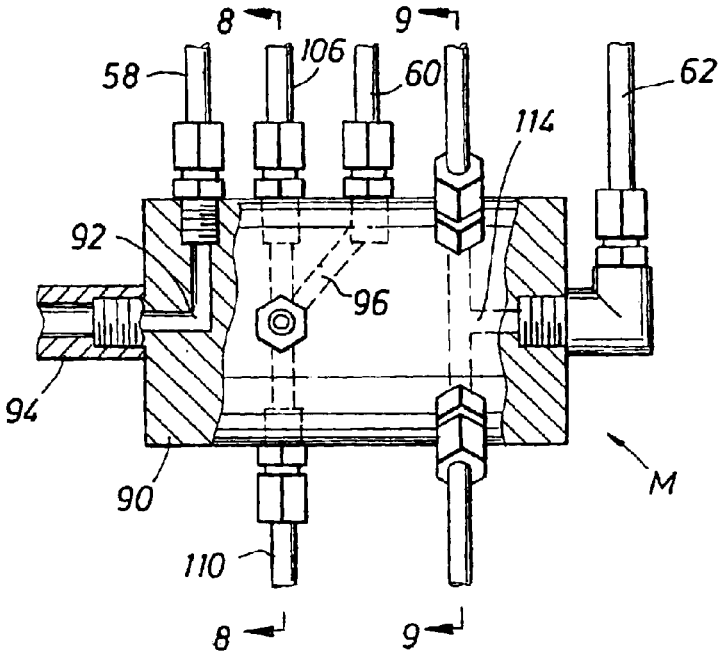
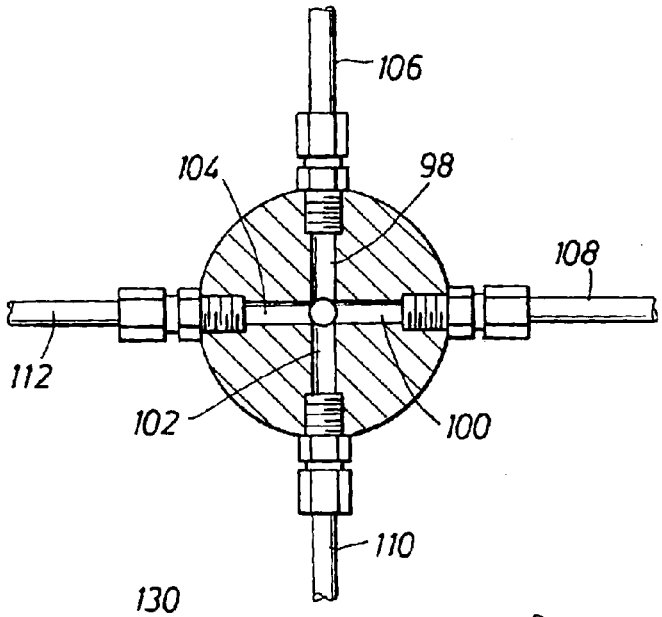
FIG.8
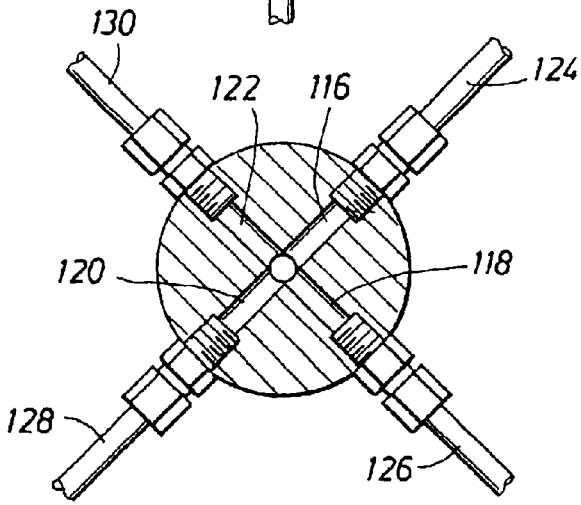
FIG.9

BURNER APPARATUS

BACKGROUND OF THE INVENTION

1. Field of the Invention

The present invention relates to a burner apparatus and, more particularly, to a burner apparatus that can be used in direct fired nitrogen vaporizers.

2. Description of the Prior Art

Direct fired nitrogen vaporizers have been used, for example, to supply nitrogen for use in various oil and gas production operations. Such vaporizers commonly burn diesel or similar liquid fuels. In a typical direct fired nitrogen vaporizer, the hot combustion gas generated by burning the liquid fuel is used to heat and vaporize a high pressured liquid nitrogen stream.

A typical direct fired nitrogen vaporizer includes a burner barrel wherein the liquid fuel is combined with air and is burned, a plurality of burner assemblies positioned in an end wall of the burner barrel, a fan that supplies air to the burner barrel, and a nitrogen tube assembly, similar to a tube/bundle heat exchanger, through which a high pressure liquid nitrogen stream flows. The high pressure liquid nitrogen stream flowing through the tube assembly is heated and vaporized by the hot combustion gasses flowing from the burner barrel. Each of the burners used in the burner barrel typically includes at least one liquid spray nozzle that is operable for spraying the liquid fuel into the burner barrel and a plurality of air slots extending radially around the periphery of the spray nozzle. The air fan operates to blow through these air slots and into the burner barrel. The flow of air from the air fan also forces the combustion gases generated in the burner barrel out of the burner barrel and through the nitrogen tube assembly.

A typical problem of prior art burner apparatuses used in direct fired nitrogen vaporizers is that there is incomplete mixing of the hot exhaust gases and the so-called secondary air that allows hot and cold areas to form in the heat exchanger. Additionally, the prior art burner apparatuses have suffered from the problem that there is a long flame front that can impinge directly on the combustion chamber and tube bundle in the exchanger, thereby shortening the life of these components. Additionally, it is not infrequent that there is incomplete combustion because of the large volume of fuel that is being sprayed from such a small area, i.e., a burner nozzle, resulting in smoke, high emissions of CO, and unburned fuel.

SUMMARY OF THE INVENTION

In a preferred aspect, the burner apparatus of the present invention includes a housing that defines a chamber, the chamber having an air inlet. There is a peripherally extending baffle disposed in the housing, a first peripherally extending flow passage being formed between the housing and the baffle, the first flow passage being in open communication with the inlet. The burner apparatus further includes a peripherally extending combustion liner disposed inwardly of the baffle, a second peripherally extending flow passage being formed between the liner and the baffle, the second flow passage being in open communication with the first flow passage. There is a reversing diverter disposed in the chamber that is positioned to direct air flowing from the first passage into the second flow passage. A burner mounting plate is disposed in the liner, the burner mounting plate having a first side and a second side, the mounting plate and the liner at least partially defining a burner barrel on the first side of the mounting plate. At least one burner assembly is mounted on the burner mounting plate. A plenum is formed on the second side of the mounting plate, which is in open communication with the second flow passage.

BRIEF DESCRIPTION OF THE DRAWINGS

FIG. 3 is an elevational view, partly in section, and taken along the lines 3—3 of FIG. 2

FIG. 4 is a cross-sectional view taken along the lines 4—4 of FIG. 2.

FIG. 7 is an elevational view, partly in section, of a fuel manifold for use in the burner apparatus of the present invention.

FIG. 8 is a view, partly in section, taken along the lines at 8—8 of FIG. 7.

FIG. 9 is view, partly in section, taken along the lines at 9—9 of FIG. 7.

DESCRIPTION OF THE PREFERRED EMBODIMENTS

While the invention will be described with reference to a direct fired nitrogen vaporizer, it is to be understood that it is not so limited. Thus, the burner apparatus of the present invention can be used in any system where there is a need to vaporize a liquified gas stream or for that matter, to vaporize relatively low boiling liquids.

Figure 1:
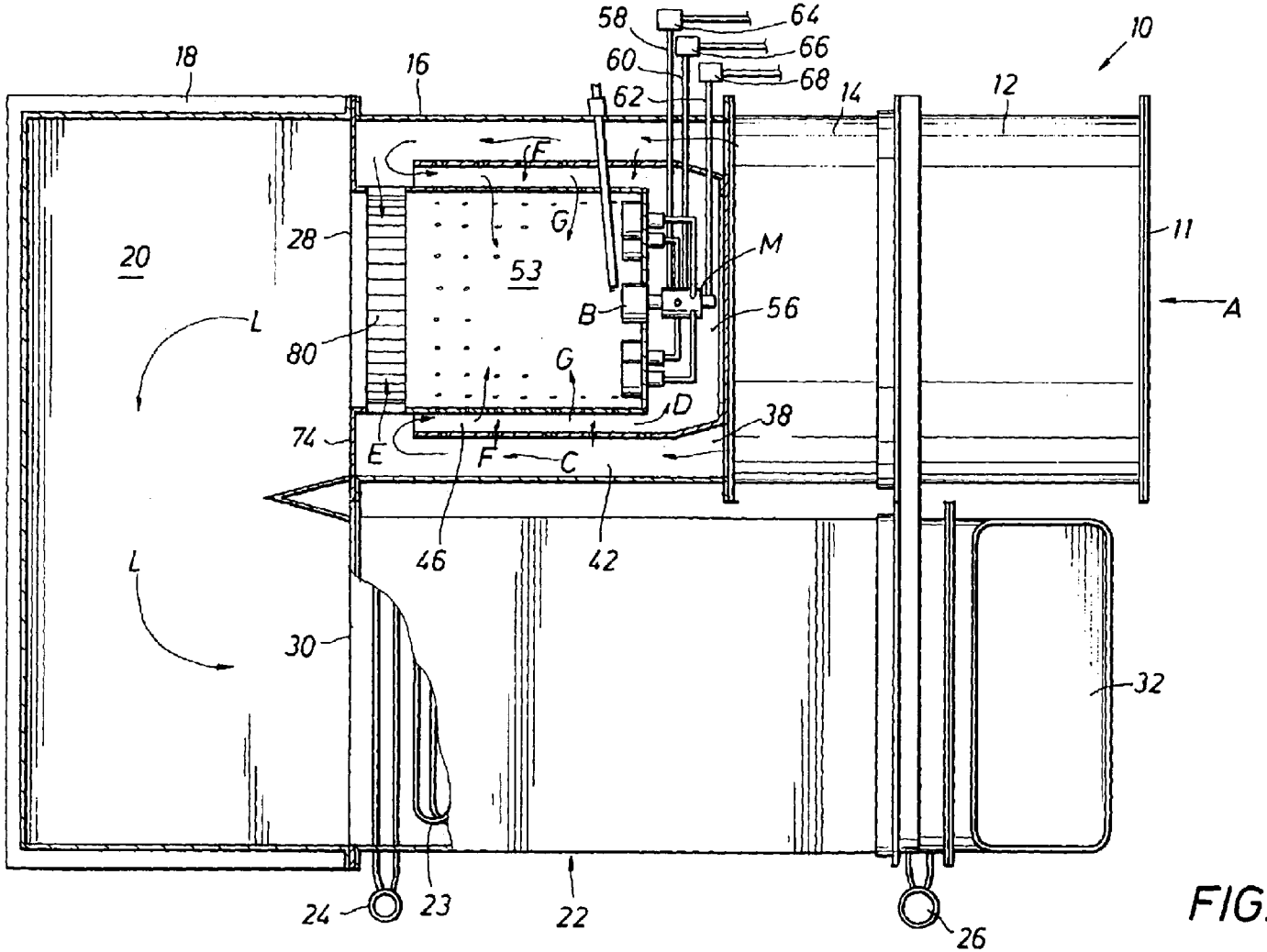
FIG. 1 is an elevational view, partly in section, showing a typical direct fired nitrogen vaporizer including the burner apparatus of the present invention.

Referring now to FIG. 1, a direct fired nitrogen vaporizer, shown generally as 10 is shown. Vaporizer 10 comprises a fan housing 12 having a fan (not shown disposed therein) there being an air intake 11 in fan housing 12. A bolt type, flange connector 14 connects fan housing 12 to a burner apparatus housing 16. Housing 16 is in turn connected to a plenum box 18 providing a plenum 20. Plenum 20 opens into a tube/shell type exchanger 22. In exchanger 22, liquid nitrogen or other liquified gas, which is to be heated/vaporized, enters via inlet 24 and passes through a series of tubes 23 interiorly of exchanger 22, vaporized nitrogen exiting via an outlet 26.

In operation, air is drawn into intake 11 in the direction shown by arrow A into fan housing 12, through connector 14 and into housing 16, and eventually passes through a plurality of burner assemblies shown as B (hereinafter described) mounted in a combustion chamber 53, the air being heated by the burner assemblies B that are fired by a combustible fuel such as diesel or the like. The heated air exits the housing 16 through an opening 28 in plenum box 18 and enters plenum 20 where it follows a path shown by the arrows L into the tube/shell exchanger 22, the hot air passing over the tubes 23 in exchanger 22 and vaporizing the liquid nitrogen therein, the air then exiting exchanger 22 via an exhaust outlet 32.

Figure 2:
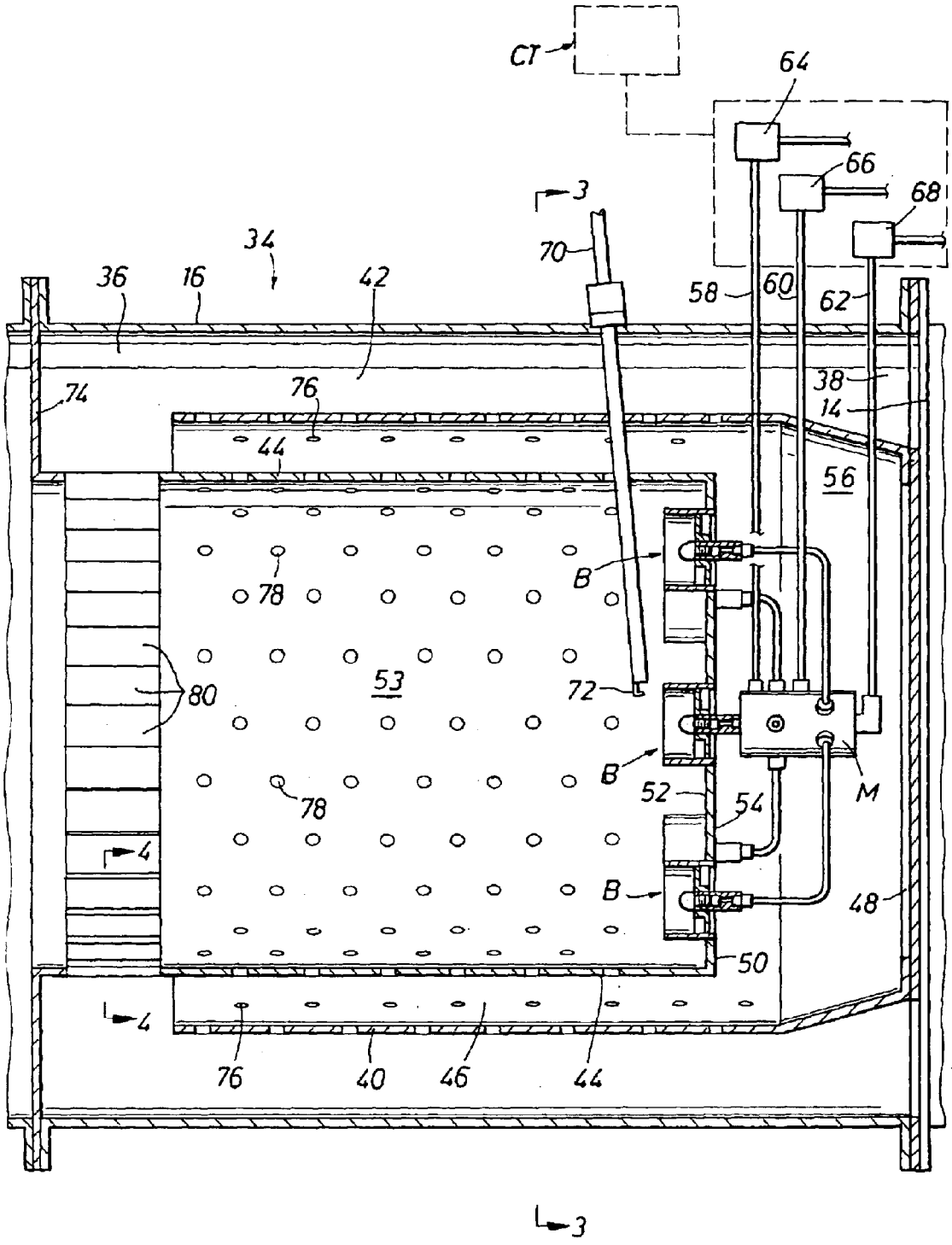
FIG. 2 is an elevational view, partly in section, showing the burner apparatus of the present invention.

Referring now to FIG. 2, the burner apparatus of the present invention, shown generally as 34 will be described.

Burner apparatus 34, as noted above, includes a housing 16 forming a chamber 36 therein. Housing 16 has an air inlet 38 in open communication with connector 14. Disposed inwardly of housing 16 is a peripherally extending baffle 40, baffle 40 and housing 16 serving to define a peripherally extending flow passage 42 through which air from inlet 38 flows. Disposed in chamber 36 inwardly of baffle 40 is a peripherally extending liner 44, liner 44 and baffle 40 serving to define a second peripherally extending flow passage 46 there between. It will be appreciated that in the usual case, housing 16, baffle 40 and liner 44 are generally cylindrical in shape such that passageways 42 and 46 are generally annular. However, it will be recognized that the cross-sectional configuration of those components is not critical, albeit that a cylindrical design is preferred.

As seen, baffle 40 is secured to a back plate or wall 48. There is a burner assembly mounting plate 50 having a first side 52 and a second side 54. The first side 52 of mounting plate 50 and liner 44 at least partially form a burner barrel defining a combustion chamber 53. The back side 54 of mounting plate 50, wall 48 and baffle 44 cooperate to define a plenum 56 on the second side 54 of mounting plate 50. As will be seen more fully hereafter, there are a plurality of burner assemblies B mounted on mounting plate 50, which are in turn connected to a manifold assembly shown generally as M disposed in plenum 56 and described more fully hereafter. Manifold M is in turn connected to a series of fuel lines 58, 60 and 62, each of which is provided with a solenoid valve 64, 66 and 68, respectively. An igniter 70 having an ignition tip 72, e.g., a spark plug, is positioned in combustion chamber 53 adjacent one of the burner assemblies B as described hereinafter.

There is an annular end wall 74 that is connected to housing 16 and liner 44, end wall 74 being disposed distal inlet 34. It will be recognized that inlet 38 is annular assuming a cylindrical cross-sectional configuration of housing 16 and baffle 40. Baffle 40 includes a plurality of perforations 76 that extend through baffle 40 and are generally arrayed around the periphery of baffle 40. The perforations or opening 76, provide open communication between passageway 42 and passageway 46. In like fashion, liner 44 includes a plurality of perforations 78 that extend through liner 44 and, as in the case of perforation 76, are generally arrayed around the periphery of liner 44. Perforations 78 allow open flow communication between passageway 46 and combustion chamber 53, i.e., into the burner barrel formed by liner 44 and mounting plate 50. The word "perforations" as used herein, means any type of opening through baffle 40 and/or liner 44 and includes slots, holes, etc. Preferably, the perforations are disposed in the baffle 40 and particularly in the liner 44 in such a pattern that they form a generally uniform distribution around the periphery of those members. Obviously, their spacing, size and shape can be varied within wide limits.

There are a series of louvers 80 formed or mounted in the periphery of liner 44, louvers 80 being located distal mounting plate 50, i.e., generally at the opposite end of combustion chamber 53. Generally, louvers 80 form a squirrel cage configuration. While louvers 80 are shown as being fixed in design in the sense that there is fixed spacing between adjacent louvers 80, it will be appreciated that the louvers could be designed to be movable to vary the distance between adjacent louvers. As best seen with reference to FIG. 4, louvers 80 are angled such that air passing therethrough into chamber 53, as shown by arrows E, is forced to spin for reasons described more fully hereafter.

Referring now back to FIG. 1, the air flow pattern through burner apparatus 34 will be described. Air entering inlet 38 passes in the direction shown by the arrows C through passageway 42 until it impinges upon annular wall 74 whereupon the direction of flow of at least a portion of the air is reversed such that it now flows through passage 46 in the direction shown by arrows D. Thus, end wall 74 effectively acts as a reversing diverter to change the direction of air flow from that shown by arrow C to that shown by arrow D. As can also be seen, a portion of the air flows through the louvers 80 as shown by arrow E. The air passing through passageway 46 eventually enters plenum 56 and then through burners B into combustion chamber 53. This air is known as "primary air."

Some of the air flowing through passageway 42 passes through the perforations 76 into passageway 46, as indicated by the arrows F. Likewise, a portion of the air in passageway 46 passes through the perforations 78 into the combustion chamber 53, as shown by arrows G. The air flowing through perforations 76, 78 and louvers 80 is referred to as "secondary air."

Referring now to FIG. 3, the burner assembly array mounted on plate 50 is shown. As can be seen, there is a center burner 1 surrounded by burners 2, 3, 4, 5, 6, 7, 8 and 9. As can be seen, ignitor tip 72 is positioned adjacent to burner assembly 1, i.e., the center burner in the array shown in FIG. 3. With reference to FIG. 7, the manifold M which is used to supply fuel to the burner assemblies B comprises a manifold block 90 that is ported as shown to provide connection between the various burner assemblies B and the incoming fuel lines, i.e., lines 58, 60 and 62. Thus, line 58 is connected by a port 92 to a line 94 that leads to burner assembly 1. In like fashion, fuel line 60 is connected by a port 96 to a series of ports 98, 100, 102 and 104 (FIG. 8), which in turn are connected via lines 106, 108, 110 and 112 to burner assemblies 2, 4, 6 and 8, respectively. Lastly, fuel line 62 is connected by a porting arrangement 114, which in turn is connected to ports 116, 118, 120 and 122 (FIG. 9), which in turn are connected to lines 124, 126, 128 and 130, which are connected to burner assemblies 3, 5, 7 and 9, respectively.

There is a control system indicated as CT that controls the solenoids 64, 66 and 68, which in turn controls the delivery of fuel through fuel lines 58, 60 and 62, respectively. Thus, the burner apparatus of the present invention provides for three levels of heating: Low Flame, Medium Flame and High Flame. During Low Flame operation, solenoid 64 would be activated to provide fuel to burner assembly 1 that could be ignited by ignitor tip 72. In this circumstance, only a single burner assembly, i.e., center burner 1 would be lit. In the Medium Flame operation, both solenoids 64 and 66 would be open permitting fuel to flow through fuel lines 58 and 60 and hence to burners 1, 2, 4, 6 and 8. In Medium Flame operation, the flame from center burner assembly 1 would ignite burner assemblies 2, 4, 6 and 8 such that a total of five burner assemblies B were burning. During High Flame operation, solenoids 64, 66 and 68 would all be open such that fuel was flowing through fuel lines 58, 60 and 62 such that now all burner assemblies B would be ignited, burner assemblies 3, 5, 7 and 9 being ignited by any of burners 1, 2, 4, 6 or 8.

Figure 5:
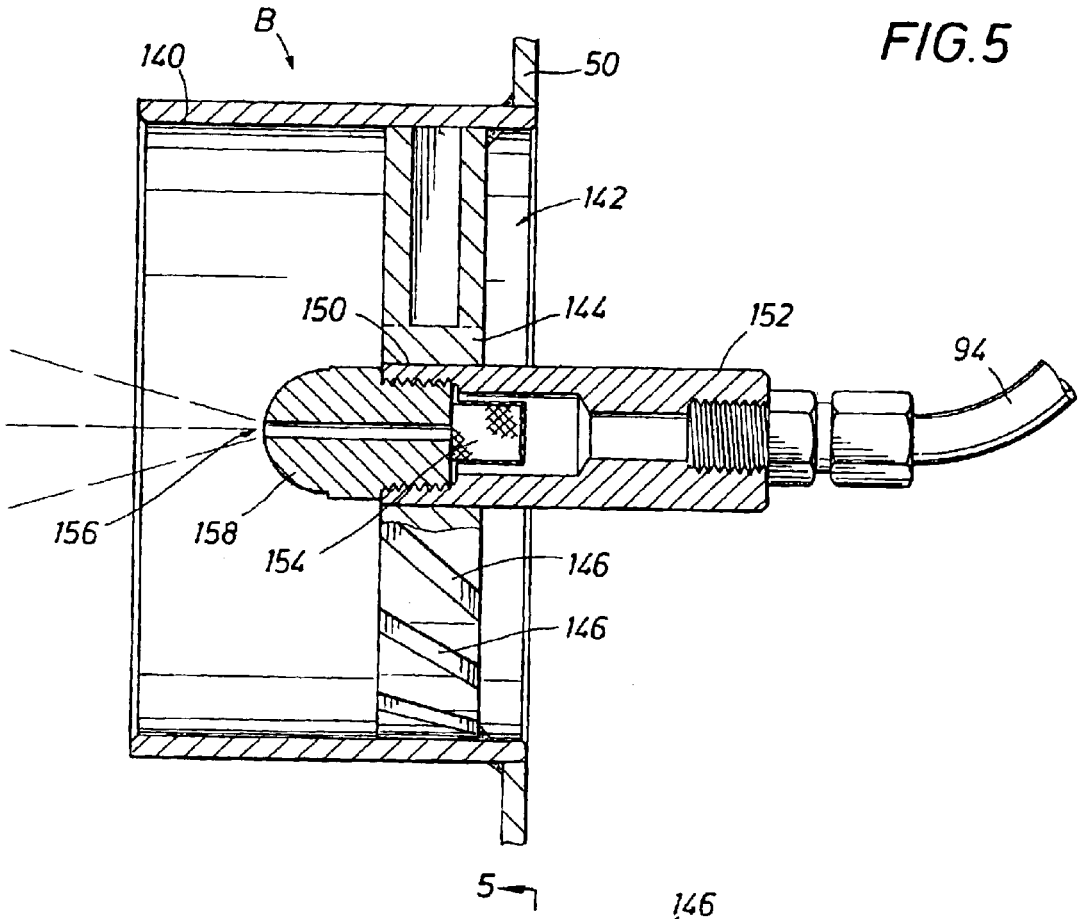
FIG. 5 is an elevational view, partly in section, of a burner assembly for use in the burner apparatus of the present invention.
Figure 6:
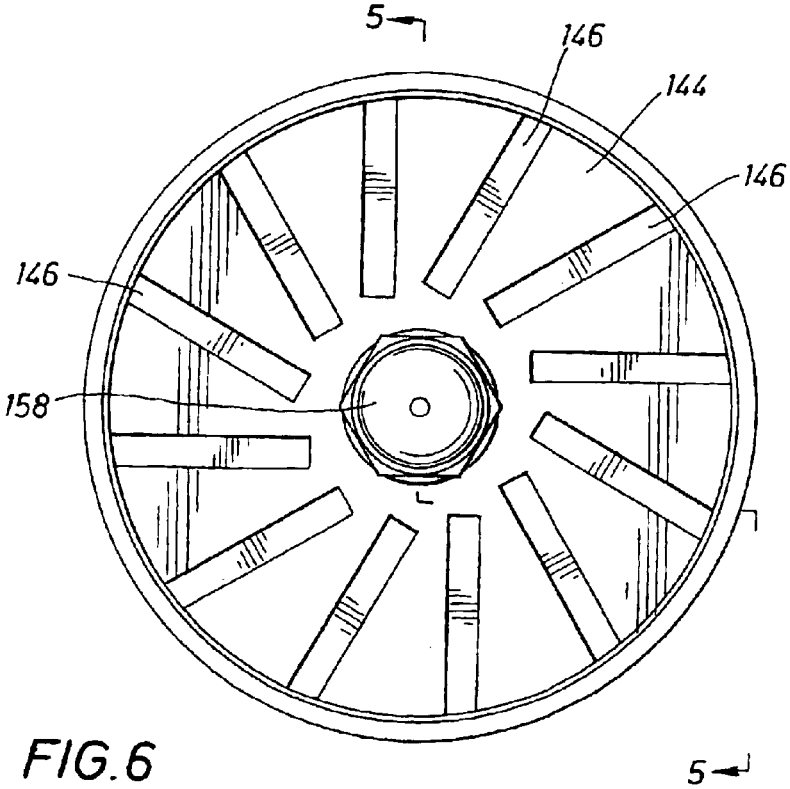
FIG. 6 is a front, elevational view, of the burner assembly shown in FIG. 5.

Referring now to FIGS. 5 and 6, the burner assemblies B of the present invention are shown in greater detail. Each burner assembly B comprises burner tube 140 that is secured to mounting plate 50 in a suitable fashion. Disposed inside burner tube 140 is a burner assembly vane 142 that, as best seen with reference to FIGS. 5 and 6 comprises a disc 144 having a series of angled slots 146 therethrough. As can be seen burner assembly vane 142 is fixedly mounted inside of burner assembly tube 140. Disc 144 has a center opening 150 through which is mounted a nozzle comprising a nozzle holder 152 that in turn is connected to fuel line 94 leading from manifold M. Fuel entering nozzle holder 152 passes through a screen 154 and the opening 156 of a nozzle head 158, the fuel spreading outwardly in a cone like pattern, as shown in FIG. 5.

In operation, the fan in fan housing 12 is activated drawing air in through intake 11 of fan housing 12. The air passes through the annular inlet 38 through passageway 42 until it impinges upon end wall 74 which forces at least a portion of it to reverse direction into passageway 46. In effect, the air passing from flow passage 42 is caused to reverse its direction as it moves into flow passage 46. The air in flow passage 46 then enters plenum 56 and is forced through the burner assembly vanes 142 in each of the burner assemblies B. Assuming, for purposes of example only, that all burner assemblies B have been ignited, the air passing through the burner vanes is caused to spin before it contacts the atomized fuel from nozzle head 158, thereby insuring a better air/fuel mixture. The vanes 142 also serve the purpose of promoting more complete combustion by increased vaporization of the atomized fuel and they tend to shorten the flame length from the burner assemblies B. In any event, the air passing through the burner assemblies B is heated by the burning fuel in the combustion chamber 53, the heated air and combustion gases then flowing through the opening 28 into plenum box 18 eventually passing through opening 30 into exchanger 22 to heat the liquid nitrogen entering the tubes 23 in exchanger 22 via inlet 24, the hot air and combustion gases, now substantially cooled, exhausting through exhaust 32 to atmosphere.

The present invention provides several unique features not found in prior art burner apparatuses and in particular, in burner apparatuses that are used in direct fired nitrogen vaporizers. Because the air flow initially entering the burner apparatus 34 is caused to reverse its flow from passageway 42 into passageway 46 and assuming the system is in operation with one or any of the above described array of burners ignited, the air passing through flow passage 46 will be preheated prior to passing through the burner assemblies B. This preheating increases combustion efficiency and also effects preheating of the fuel before it is atomized, which increases fuel vaporization for increased combustion efficiency. In this regard, note that the manifold M is disposed in the plenum 56 and the preheated air flowing in the plenum 56 will of course heat the fuel in manifold M before it enters the nozzles of the various burner assemblies as well as heating the fuel sprayed from the nozzle opening 156. Additionally, the air passing through flow passage 46, while being heated from the combustion in combustion chamber 53, also serves to cool liner 44 extending its life and permitting the use of less expensive liner materials. This reversing pattern of air flow also serves another significant advantage. As noted above, baffle 40 and liner 44 have a series of perforations therethrough. These perforations allow the bleeding of secondary air. The preheated air in flow passage 46 also serves to heat the secondary air bleeding into combustion zone 53 through perforations 78. This aids in improving the temperature distribution of air ultimately passing through heat exchanger 22, i.e., it reduces hot spots and cold spots in the heat exchanger, thereby increasing heat exchanger life and increasing heat exchanger efficiency. As this secondary air bleeds into combustion chamber 53, it tends to push the flame radially away from combustion liner 44, thereby keeping the flame centered within liner 44 that again acts to keep the liner 44 cooler. Additionally, the secondary air bleeding into the combustion chamber 53 evenly distributes with the flame and hot exhaust gases to improve the temperature distribution of air that ultimately goes into heat exchanger 22. The secondary air passing through perforations 78 also serves to reduce the formation of $NO_x$ emissions and acts to direct unburned fuel from the spray nozzles toward the flame, i.e., toward the center of the burner barrel. This makes for more complete combustion as well as forcing the fuel away from the combustion liner 44 where it would condense and hence not be burned. In effect, the secondary air bleeding into the combustion chamber 53 creates a "boundary layer" adjacent liner 44.

The louvers 80 disposed at the end of the liner 44 also permit secondary air to enter the mouth of the combustion chamber 53 and because of their design spin the secondary air as well as the flame and hot gases as they leave combustion chamber 53. The spinning action mixes the flame, hot gases and secondary air to improve the temperature distribution of hot gases ultimately passing through heat exchanger 22. Additionally, the spinning of the secondary air by louvers 80 reduces the flame length, thereby reducing damage to plenum 20 and heat exchanger tubes that could be caused by direct contact with the flame from the combustion chamber 53. The louvers also serve the purpose of allowing more time and distance for the exhaust air from combustion chamber 53 to completely mix with the secondary air passing through the perforations 78 in the liner 44 as well as through the louvers 80 which results in increased heat exchanger life and efficiency.

The perforations in baffle 40 permits secondary air initially introduced into flow passage 42 to cool baffle 40 as well as providing more cool air to liner 44, thereby enhancing the life of both baffle 40 and liner 44. Additionally, the perforations in baffle 40 serve to permit increased air flow through the entire burner apparatus.

The pattern of the burner assemblies B, as shown in FIG. 3, coupled with the burner assembly structure, provides several unique and beneficial results. The vane 144 in each burner assembly B spins the air regardless of whether fuel is being supplied to a particular burner assembly or not. This spinning of the air coupled with the pattern of the burner assemblies creates a balance between each of the burner assemblies B within the combustion chamber 53 to promote a stable flame pattern. The pattern of the burner assemblies coupled with the spinning air from each burner assembly allows self ignition of surrounding nozzles once the center nozzle, i.e., the nozzle in burner assembly 1 is lit. It also allows the use of multiple burner assemblies in one common combustion chamber 53 using a simplified ignition and control circuit.

The foregoing description and examples illustrate selected embodiments of the present invention. In light thereof, variations and modifications will be suggested to one skilled in the art, all of which are in the spirit and purview of this invention.

What is claimed is:

1. a burner apparatus comprising:

a housing defining a chamber and having an air inlet;

a peripherally extending baffle disposed in said housing, a first peripherally extending flow passage being formed between said housing and said baffle, said first flow passage being in open communication with said air inlet;

a peripherally extending combustion liner disposed inwardly of said baffle, a second peripherally extending flow passage being formed between said liner and said baffle, said second flow passage being in open communication with said first passage;

a reversing diverter disposed in said chamber, said diverter being positioned to direct air flowing from said first flow passage into said second flow passage;

a burner assembly mounting plate disposed in said liner, said burner mounting plate having a first side and a second side, said mounting plate and said liner at least partially defining a burner barrel on the first side of said mounting plate there being at least one liner perforation through said liner providing open communication between said second flow passage and said burner barrel;

at least one burner assembly mounted on said burner mounting plate; and a plenum on the second side of said mounting plate, and being in open communication with said second flow passage.

2. The burner apparatus of claim 1 wherein said baffle has at least one baffle perforation through said baffle providing open communication between said first flow passage and said second flow passage.

3. The burner apparatus of claim 2 wherein there are a plurality of said baffle perforations.

4. The burner apparatus of claim 1 wherein there are a plurality of said liner perforations.

5. The burner apparatus of claim 1 wherein there are a plurality of peripherally disposed louvers providing open communication between said first flow passage and said combustion barrel, said louvers being disposed distal said mounting plate.

6. The burner apparatus of claim 1 wherein there are a plurality of burner assemblies mounted on said burner mounting plate.

7. The burner apparatus of claim 6 wherein at least one of said assemblies is generally centrally located on said mounting plate and the other of said assemblies are mounted in surrounding relationship thereto said burner assemblies include a nozzle, and there is an igniter for igniting combustible fuel passing through said nozzle of at least one of said burner assemblies.

8. The burner apparatus of claim 7 wherein said mounting plate has a plurality of openings providing open communication between said plenum and said burner barrel and each of said burner assemblies comprises:

a burner assembly tube in surrounding relationship to said opening; and a nozzle disposed in said burner tube for introducing a combustible fuel into said burner barrel.

9. The burner apparatus of claim 8 wherein each of said burner assemblies further includes a burner assembly vane disposed in said burner assembly tube, said burner vane providing a series of radially extending, circumferentially spaced slots.

10. The burner apparatus of claim 9 wherein said slots are configured to impart a rotational pattern to air passing through said burner vane.

11. The burner apparatus of claim 10 wherein said nozzle is disposed centrally in said burner vane.

12. The burner apparatus of claim 7 wherein there is an igniter for igniting a combustible mixture passing through said nozzle in said burner assembly centrally located on said mounting plate.

13. The burner apparatus of any of claim 7 or 12 wherein selected arrays of burner assemblies can be ignited.

14. The burner apparatus of claim 1 wherein said mounting plate has an opening providing open communication between said plenum and said burner barrel and said burner assembly comprises:

a burner tube in surrounding relationship to said opening; and a nozzle disposed in said burner tube for introducing a combustible fuel into said burner barrel.

15. The burner apparatus of claim 14 wherein said burner assembly further includes a burner vane disposed in said burner tube, said burner vane providing a series of radially extending, circumferentially spaced slots.

16. The burner apparatus of claim 15 wherein said slots are configured to impart a rotational pattern to air passing through said burner vane.

17. The burner apparatus of claim 15 wherein said nozzle is disposed centrally of said burner vane.

18. The burner apparatus of claim 14 wherein there is an igniter for igniting a combustible mixture passing through said nozzle into said burner barrel.

19. A multiple burner assembly apparatus comprising:

a burner assembly mounting plate, said burner assembly mounting plate having a generally centrally located opening and a plurality of additional openings laterally spaced from said centrally located opening and generally equally spaced from said centrally located opening and each other;

a burner assembly disposed in each of said openings, each of said burner assemblies comprising:

a burner assembly tube in surrounding relationship to said opening;

a nozzle disposed in said burner assembly tube for introducing a combustible fuel and a burner assembly vane disposed in said burner assembly tube, said vane including a series of radially extending, circumferentially spaced slots.

20. The multiple burner assembly apparatus of claim 19 wherein said slots are configured to impart a rotational pattern to air passing through said burner assembly vane.

21. The multiple burner assembly apparatus of claim 19 wherein said nozzle is disposed centrally in said burner assembly vane.

22. The multiple burner assembly apparatus of claim 19 wherein there is an igniter for igniting a combustible mixture passing through said nozzle in said burner assembly generally centrally located on said mounting plate.

23. The multiple burner assembly apparatus of claim 19 wherein said additional openings are arrayed in a generally circular pattern around said centrally located opening.

24. The multiple burner assembly apparatus of claim 23 wherein there are eight of said additional openings.

25. a burner apparatus comprising:

a housing defining a chamber and having an air inlet;

a peripherally extending baffle disposed in said housing, a first peripherally extending flow passage being formed between said housing and said baffle, said first flow passage being in open communication with said air inlet;

a peripherally extending combustion liner disposed inwardly of said baffle, a second peripherally extending flow passage being formed between said liner and said baffle, said second flow passage being in open communication with said first passage;

a reversing diverter disposed in said chamber, said diverter being positioned to direct air flowing from said first flow passage into said second flow passage;

a burner assembly mounting plate disposed in said liner, said burner mounting plate having a first side and a second side, said mounting plate and said liner at least partially defining a burner barrel on the first side of said mounting plate;

at least one burner assembly mounted on said burner mounting plate; and a plenum on the second side of said mounting plate, and being in open communication with said second flow passage whereby any air flowing into said plenum from said second flow passage is heated by combustion gases formed in said burner barrel prior to entering said plenum, said baffle has at least one baffle perforation through said baffle providing open communication between said first flow passage and said second flow passage.

26. The burner apparatus of claim 25 wherein there are a plurality of said baffle perforations.

27. The burner apparatus of any of claim 25 wherein there is at least one liner perforation through said liner providing open communication between said second flow passage and said burner barrel.

28. The burner apparatus of claim 27 wherein there are a plurality of said liner perforations.

29. The burner apparatus of any of claim 25 wherein there are a plurality of peripherally disposed louvers providing open communication between said first flow passage and said combustion barrel, said louvers being disposed distal said mounting plate.

30. The burner apparatus of any of claim 25 wherein there are a plurality of burner assemblies mounted on said burner mounting plate.

31. The burner apparatus of claim 30 wherein at least one of said assemblies is generally centrally located on said mounting plate and the other of said assemblies are mounted in surrounding relationship thereto, said burner assemblies include a nozzle, and there is an igniter for igniting combustible fuel passing through said nozzle of at least one of said burner assemblies.

32. The burner apparatus of claim 31 wherein said mounting plate has a plurality of openings providing open communication between said plenum and said burner barrel and each of said burner assemblies comprises:

a burner assembly tube in surrounding relationship to said opening; and a nozzle disposed in said burner tube for introducing a combustible fuel into said burner barrel.

33. The burner apparatus of claim 32 wherein each of said burner assemblies further includes a burner assembly vane disposed in said burner assembly tube, said burner vane providing a series of radially extending, circumferentially spaced slots.

34. The burner apparatus of claim 33 wherein said slots are configured to impart a rotational pattern to air passing through said burner vane.

35. The burner apparatus of claim 34 wherein said nozzle is disposed centrally in said burner vane.

36. The burner apparatus of claim 31 wherein there is an igniter for igniting a combustible mixture passing through said nozzle in said burner assembly centrally located on said mounting plate.

37. The burner apparatus of claim 36 wherein selected arrays of burner assemblies can be ignited.

38. The burner apparatus of any of claim 25 wherein said mounting plate has an opening providing open communication between said plenum and said burner barrel and said burner assembly comprises:

a burner tube in surrounding relationship to said opening; and a nozzle disposed in said burner tube for introducing a combustible fuel into said burner barrel.

39. The burner apparatus of claim 38 wherein said burner assembly further includes a burner vane disposed in said burner tube, said burner vane providing a series of radially extending, circumferentially spaced slots.

40. The burner apparatus of claim 39 wherein said slots are configured to impart a rotational pattern to air passing through said burner vane.

41. The burner apparatus of claim 39 wherein said nozzle is disposed centrally of said burner vane.

42. The burner apparatus of claim 38 wherein there is an igniter for igniting a combustible mixture passing through said nozzle into said burner barrel.

* * * * *